United States Patent [19]

Ryan et al.

[11] 4,351,277

[45] Sep. 28, 1982

[54] SOOTBLOWER FOR ECONOMIZER

[75] Inventors: Jerry E. Ryan; Edward E. Grove, both of Tulsa, Okla.

[73] Assignee: Tranter, Inc., Tulsa, Okla.

[21] Appl. No.: 227,812

[22] Filed: Jan. 23, 1981

[51] Int. Cl.[3] ..... F22B 37/52

[52] U.S. Cl. ..... 122/390; 15/318; 122/392; 165/95

[58] Field of Search ..... 122/390, 391, 392; 15/316 R, 317, 318; 165/95

[56] References Cited

U.S. PATENT DOCUMENTS

| | | | |
|---|---|---|---|
| 987,450 | 3/1911 | Eichelberger et al. | 122/391 X |
| 1,095,991 | 5/1914 | Bennett | 122/391 |
| 1,729,567 | 9/1929 | Collins | 122/390 |
| 4,031,862 | 6/1977 | Smith | 122/392 X |

FOREIGN PATENT DOCUMENTS

| | | | |
|---|---|---|---|
| 156533 | 8/1903 | Fed. Rep. of Germany | 122/390 |

*Primary Examiner*—Edward G. Favors
*Attorney, Agent, or Firm*—William S. Dorman

[57] ABSTRACT

A sootblower for an economizer of the type having a vertically extending cylindrical casing in which is mounted a plurality of spiral coils arranged parallel to each other in concentric relation with respect to the central vertical axis of the cylindrical casing. The spiral coils are in the form of finned tubes, the coils being disposed in closely spaced relation but providing clearance between the fins on adjacent coils. A heat exchange fluid is conducted through the spiral coils whereby the coils can extract heat from exhaust gases passing upwardly through the economizer from a boiler. The sootblower is mounted in the casing below the spiral coils and includes a pair of horizontally disposed structural tubular members arranged across the casing adjacent the bottom thereof, a vertically extending connecting pipe passing through a first one of the tubular members in concentric relation with respect to the casing, a steamline extending horizontally into the interior of the casing below the coils and terminating in an interior ball joint elbow, the upper end of the vertical connecting pipe being provided with an enlarged ball opening which is received within the ball joint elbow forming a fluid-tight fit with the ball but allowing a 360° movement of the vertical connecting pipe, a horizontal arm extending outwardly from the lower end of the vertical connecting pipe, and a plurality of nozzles on the upper surface of the arm for directing jets of steam into the spaces between adjacent coils.

2 Claims, 5 Drawing Figures

SOOTBLOWER FOR ECONOMIZER

BACKGROUND OF THE INVENTION

1. Field of the Invention

The present invention relates to a sootblower for removing particles of soot from the coils of a heat exchanger commonly referred to as an "economizer".

2. Description of the Prior Art

Heat exchangers of the type disclosed herein, which are customarily referred to as "economizers", are generally arranged in vertically spaced and essentially horizontal rows of coils, each horizontal row or assembly of coils is usually in the form of concentric coils which are spaced horizontally from each other. All of these coils are in the form of finned tubes. When the exhaust gases from a boiler pass upwardly through the economizer, particles of soot tend to accumulate on the coils and on the fins so that it becomes necessary to remove the soot from time to time. The art teaches that it is old to remove soot from boilers themselves as typified by U.S. Pat. Nos. 822,813; 838,898; 858,333; 987,450 1,053,842; 1,497,172; 1,581,005; 1,729,567; 1,865,080; and 1,889,859. However, none of the above patents show or suggest the use of a sootblower in conjunction with an economizer or other similar heat exchanger.

SUMMARY OF THE INVENTION

A cylindrical heat exchanger or economizer is adapted to be installed in the exhaust stack of a boiler so as to extract heat from exhaust gases from the boiler. Within the economizer from a point adjacent the top of the economizer to a point spaced somewhat above the bottom of the economizer are a plurality of vertically extending spiral coils in the form of finned tubes. These spirally arranged coils are parallel to each other and concentric with respect to the central vertical axis of the economizer. The coils vary in size (diameter) from an inner coil having a predetermined minimum diameter to an outer coil having a maximum diameter approximating the diameter of the economizer itself. The spirals are arranged in closely spaced relation to each other, but still providing some clearance between the fins on adjacent coils. Each concentric coil, from the smallest to the largest, is provided with an upper end which is connected to an inlet header and a lower end which is connected to an outlet header. However, the effect of this arrangement is to provide an assembly of vertically spaced horizontal, or nearly horizontal, rows of finned tubes.

In the normal operation of the economizer, soot will tend to build up on the coils and on the fins so as to require periodic removal. For the purpose of removing soot, a rotatable arm is mounted in the bottom of the economizer below the coils. The rotatable arm is provided with nozzles which are spaced apart a distance approximately equal to the spacing between adjacent concentric coils and which are further positioned so as to direct jets of steam into the spaces between the adjacent coils. A pair of structural tubular members arranged in the form of a cross are disposed across the economizer just above the bottom. The rotatable arm is rotatable connected to one of these structural tubular members at the center of the economizer where the two structural members are connected to each other. The inner end of the rotatable arm is provided with an elbow which connects with a vertical connecting arm, the upper end of which is provided with an enlarged ball opening. The ball opening is received within a ball joint elbow which is connected to the inner end of a low pressure steam line. The relationship between the ball joint elbow and the ball on the vertical connecting pipe is such as to provide a fluid-type fit but which permits a 360° movement of the rotating arm. The rotating arm is rotatably connected through one of the structural tubular members by means of a pair of pipe plugs which screw into a pair of half couplings attached to the top and bottom of the structural tubular member. Asbestos rope is placed inside each half coupling around the connecting pipe between each pipe plug and the structural member. A roller chain sprocket fits around the connecting pipe within the structural tubular member so as to be rotatable with the connecting pipe. A second sprocket is disposed external of the economizer and a roller chain passes around both sprockets and in engagement with the sprockets. The outer sprocket is attached to a right angle drive mechanism. The right angle drive mechanism can be remotely controlled, for example, at ground level by means of a third chain and sprocket arrangement. Thus, when it is desired to remove soot from the coils and fins, steam is introduced through the steam line and the right angle drive mechanism is operated through its remote chain and sprocket arrangement to turn the rotatable arm whereby jets of steam pass upwardly through the coils and fins to remove soot therefrom.

DETAILED DESCRIPTION OF THE PREFERRED EMBODIMENTS

Referring to drawings in detail, FIGS. 1 through 5 show a soot removal system for a cylindrical heat exchanger or economizer. Economizers are usually installed in boiler exhaust stacks wherein they extract heat from exhaust gases which would otherwise be lost to the atmosphere. To maximize heat transfer in an economizer, soot deposited on the heat exchange coils (hereinafter sometimes referred to in the singular as "coil") by the exhaust gases must be removed periodically. The method of soot removal hereby proposed will effectively remove soot by means of medium pressure steam blown upward through the economizer from a movable arm rotating directly beneath the heat exchange coil.

Figure 1:
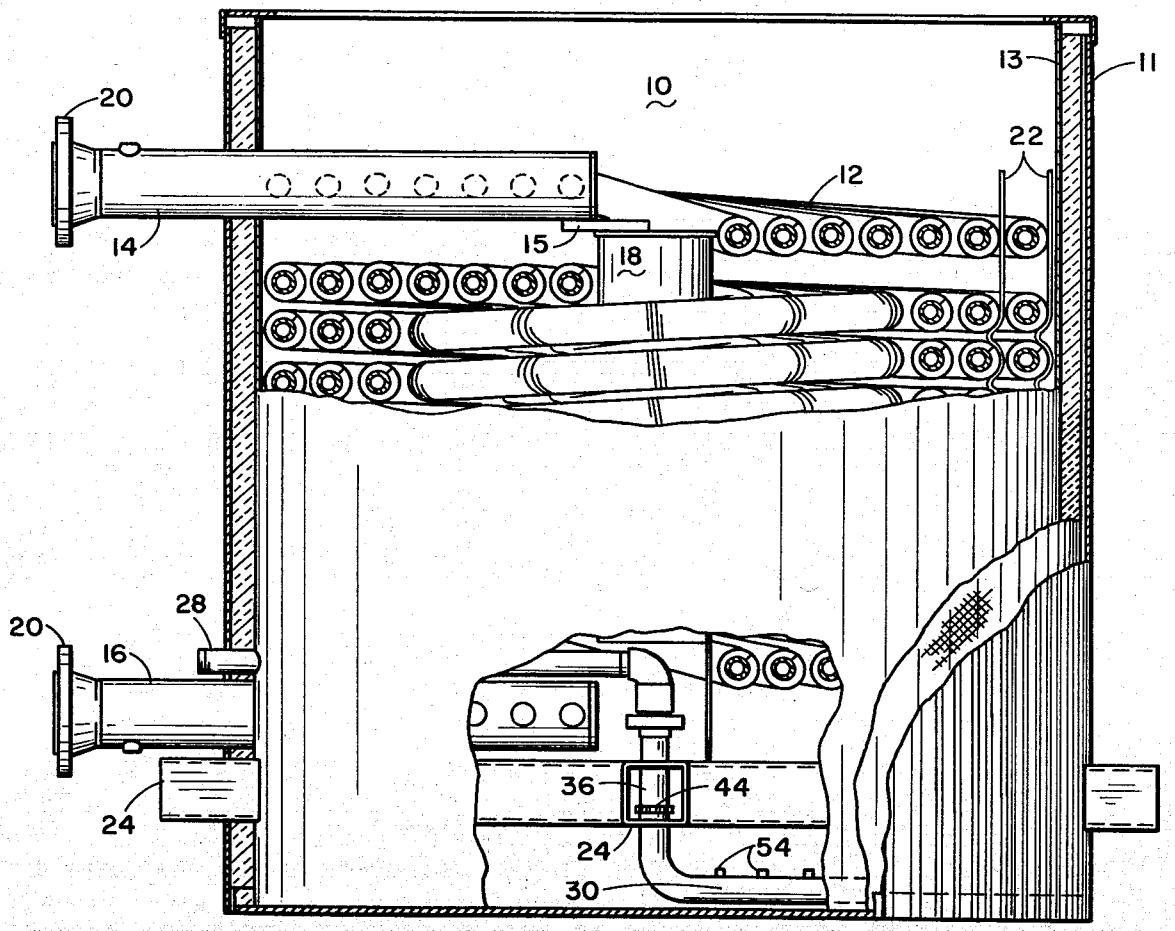
FIG. 1 is a front elevation of an economizer incorporating the sootblower of the present invention, showing certain parts in section and certain parts broken away for convenience of explanation.
Figure 2:
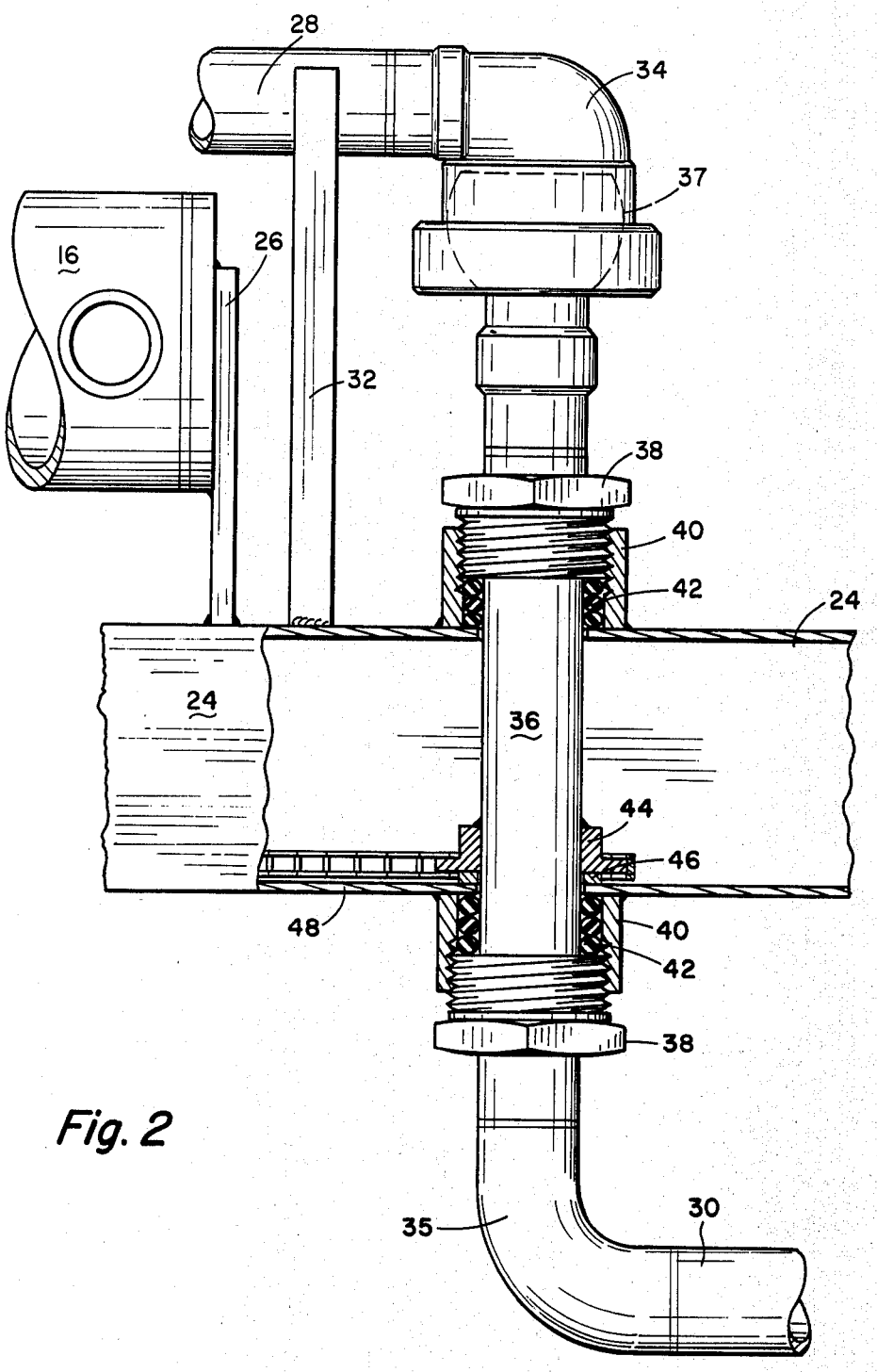
FIG. 2 is a fragmentary front elevation, on an enlarged scale, of certain of the components of the sootblower as shown in the lower portion of FIG. 1.
Figure 3:
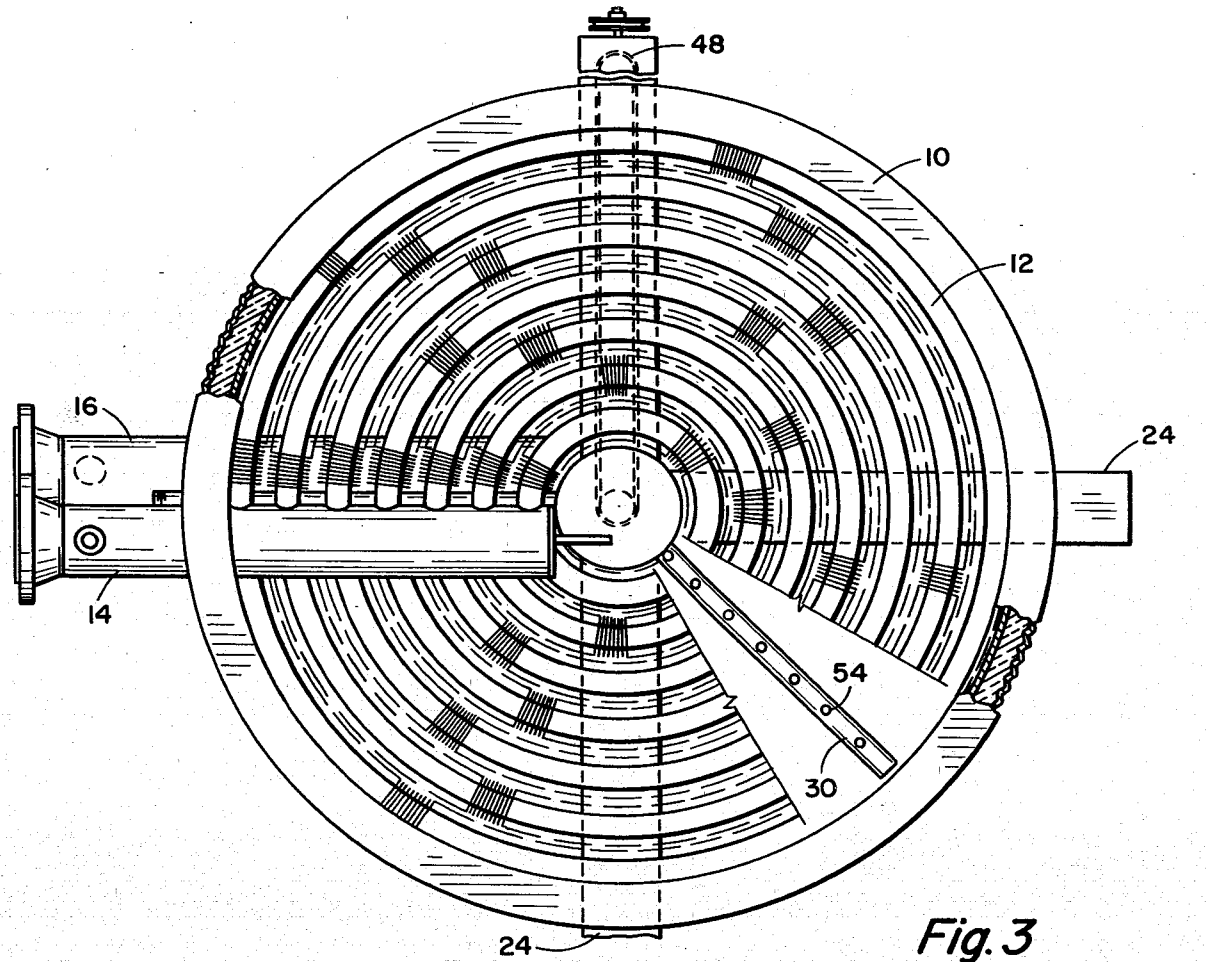
FIG. 3 is a plan view of the economizer shown in FIG. 1, with certain parts being broken away for explanatory purposes.

As seen in FIG. 1 the economizer 10 is in the shape of a vertical cylinder with an outer casing 11 separated from an interior lining 13 by mineral wool insulation. Within the lining 13 from a point adjacent the top to a point spaced somewhat above the bottom are a plurality of vertically extending spiral coils 12 in the form of finned tubes. These spirally arranged coils 12 are parallel to each other and concentric with respect to the central vertical axis of the economizer. The coils vary in size (diameter) from an inner coil (surrounding a central structural member 18) having a predetermined minimum diameter to an outer coil having a maximum diameter approximating the diameter of the lining 13. The spirals are arranged in closely spaced relation to each other, but still providing some clearance between the fins on adjacent coils. In the embodiment shown in FIGS. 1 through 4, for example, there are seven parallel coils, as best seen in FIGS. 1 and 3. Each concentric coil, from the smallest to the largest, is provided with an upper end which is connected to an inlet header 14 and a lower end which is connected to an outlet header 16. However, the effect of this arrangement is to provide an assembly of vertically spaced horizontal, or nearly horizontal, rows of finned tubes. The resulting (nearly) horizontal rows or assemblies are spaced vertically from each other for the major height of the economizer 10. The inlet header 14, which is located near the top of the economizer, and outlet header 16, which is spaced above the bottom of the economizer, are each sealed at their inner ends, with their outer ends extending through the outer casing 11 of the economizer 10 and being provided with standard flanged fittings 20 to permit connection to piping (not shown). On the inside of the economizer 10, the sealed end of the inlet header 14 is supported by a plate 15 attached to a center structural member 18 of the economizer 10. The inner sealed end of the outlet header 16 is attached by a brace plate 26 to one of a pair of square structural tubular members 24 which are arranged across the bottom of the economizer in the form of a cross.

Returning to FIG. 1, the finned tubes 12 of the heat exchange coil can be held in concentric circles around the center structural member 18 by a plurality of support rods 22 (only two of which are shown). The spacing between the finned tubes 12 of the heat exchange coil allows the boiler exhaust gases to pass through the economizer 10. To remove the soot particles, deposited by the exhaust gases, from the finned tubes 12 of the heat exchange coil, streams of medium pressure steam are sprayed upward from an arm 30 which rotates directly beneath the heat exchange coil. As seen also in FIG. 2, steam is provided to the rotating arm 30 by a steamline 28 connected to an outside source (not shown) such as the boiler itself. The steamline 28 is held in place by a brace 32 attached to the square structural tubing 24. The manner in which the rotating arm 30 is connected to the steamline 28 will now be described.

The inner end of the rotatable arm 30 (which is otherwise essentially horizontal) is provided with an integral elbow 35 to which a vertical pipe 36 is connected so as to form a vertical extension of the arm 30. The upper end of the connecting pipe 36 is provided with an enlarged ball opening 37 which is received within the lower end of a ball joint elbow 34 which is connected to the inner end of the steamline 28. The ball joint elbow 34 not only forms a fluid-tight fit with the ball 37, but it also allows 360° movement of ball and, hence, the rotating arm 30 itself. The connecting pipe 36 is held in place by a pair of pipe plugs 38 screwed into a pair of half couplings 40 attached to the top and bottom of the square structural tubing 24. Stuffing material, such as an asbestos rope 42 of small diameter is placed inside of each half coupling 40 around the connecting pipe 36 between each pipe plug 38 and the square structural tubing 24.

Figure 4:
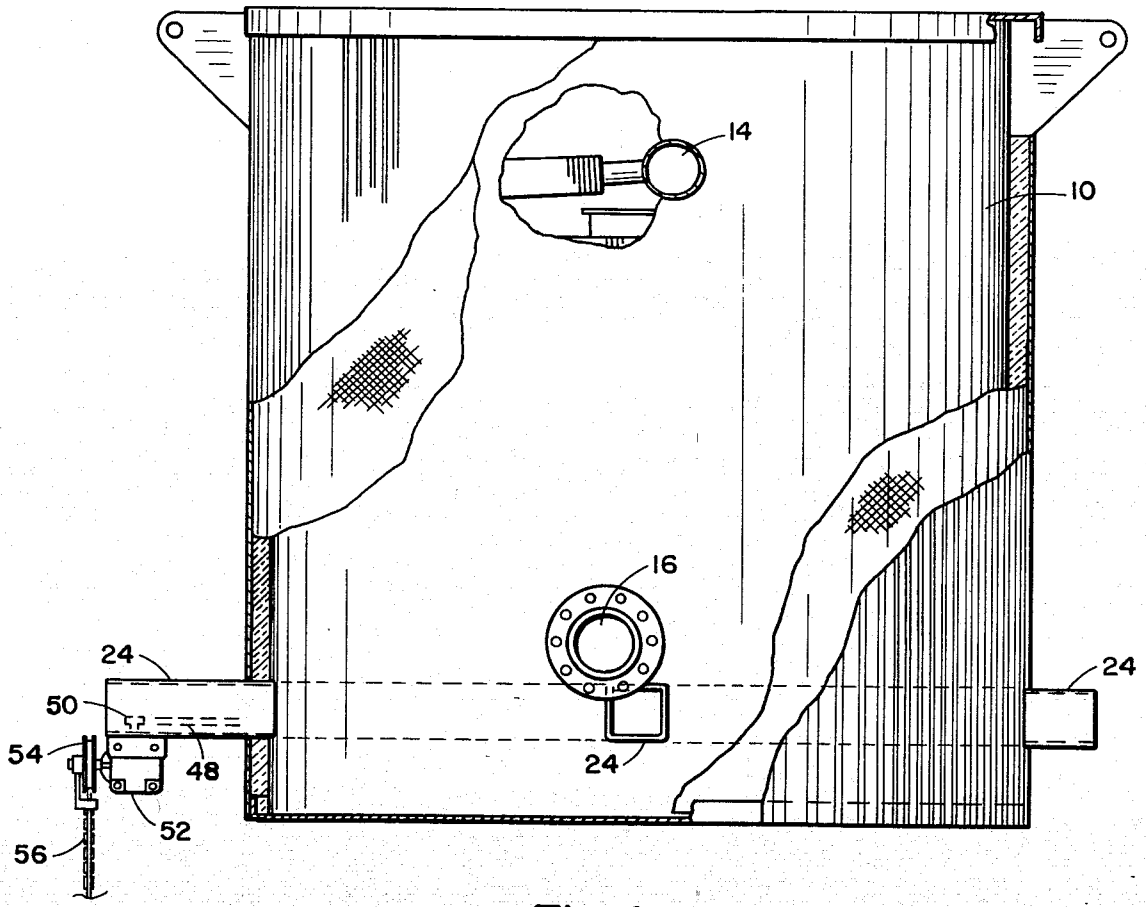
FIG. 4 is a side elevation, partly in section, with certain parts broken away.

Inside one of the square structural tubular members 24 a roller chain sprocket 42 fits around the connecting pipe 36 so as to be rotatable therewith. A washer 46 is placed between the roller chain sprocket 44 and the square structural tubular member 24. As seen in FIGS. 3 and 4, a roller chain 48 engages the sprocket 44 and tracks through this square structural tubular member 24 to a roller chain sprocket 50 attached to the output shaft of a right angle drive mechanism 52 mounted on the outside of the casing 11 adjacent the outer end of this square tubular member 24. A third sprocket 54 attached to the input shaft of the right angle drive and another chain 56 which passes around this third sprocket permits remote operation of the right angle drive 52, for example, from ground level. Operation of the right angle drive mechanism 52, through the chain 56, will engage the roller chain 48 with roller chain sprockets 50 and 44 and cause rotation of the connecting pipe 36 and the rotating arm 30. Directly beneath the heat exchange coil, the rotating arm 30 makes a 90° angle with the connecting pipe 36, and on the horizontal portion of the rotating arm 30 are spaced nozzles 54 which produce jets of medium pressure steam which are sprayed upward through the economizer 10 around the finned tubes 12 loosening the soot and causing it to be blown out of the economizer 10 with the exhaust gases. The nozzles 54 are preferably disposed directly beneath the spaces between adjacent coils.

Figure 5:
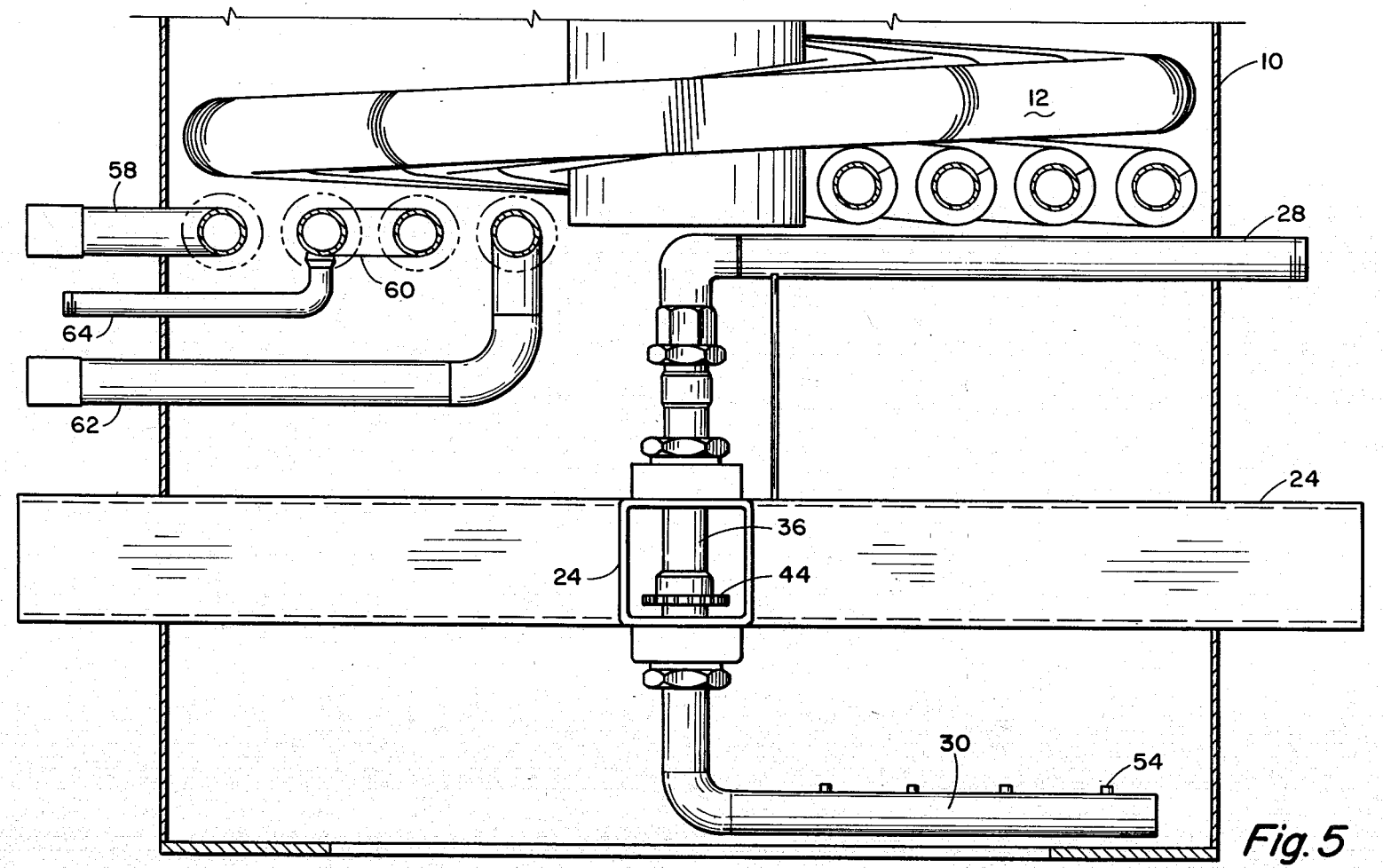
FIG. 5 is a cross-sectional view, on a somewhat enlarged scale, and similar to the lower portion of FIG. 1, but showing a modified form of economizer employing four coils in series.

FIG. 5, in addition to showing details of the sootblower itself, shows a modified form of economizer employing only four coils 12 connected in series. Thus, the need for inlet and outlet headers is eliminated. The inlet connection to the outer coil is represented by inlet pipe 58. The outer coil would be connected at the top (not shown) to the adjacent inner coil, whereas the two center coils are series connected at the bottom by the pipe 60. The innermost coil 12 is series connected at the top (not shown) to the next adjacent outer coil. An outlet pipe 62 is connected to the bottom of the inner coil. A drain 64 can be connected to the bottom junction between the center two coils to remove any condensate as desired. In the embodiment shown in FIG. 5, only four nozzles 54 are required on the arm 30, whereas seven nozzles 54 are preferably employed in the embodiment of FIGS. 1 to 4.

Under normal operating conditions, a temperature drop recorded at the outlet header 16 indicates that soot deposited by the exhaust gases on the finned tubes 12 of the heat exchange coil has reduced the amount of heat that the heat exchange coil can extract from the exhaust gases. To remove the soot, steam is turned on to the steamline 28 and the right angle mechanism 52 is actuated to move the rotating arm 30 beneath the heat exchange coil. As the rotating arm 30 moves, steam is sprayed directly upward into the heat exchange coil from the nozzles 54 positioned on the top of the rotating arm 30. A rise and subsequent stabilization of the outlet header temperature is an indication that the soot has been removed and heat is again being effectively transferred between the heat exchange coil and the exhaust gases.

Whereas the present invention has been described in particular relation to the drawings attached hereto, it should be understood that other and further modifications, apart from those shown or suggested herein, may be made within the spirit and scope of this invention.

What is claimed is:

1. In an economizer of the type having a vertically extending cylindrical casing, a plurality of spirally arranged coils parallel to each other in concentric relation with respect to the central vertical axis of the cylindrical casing, said spiral coils being in the form of finned tubes, the coils being arranged in closely spaced relation but providing clearance between the fins on adjacent coils, means for passing a heat exchange fluid through the spiral coils whereby the coils can extract heat from exhaust gases passing upwardly through the economizer from a boiler; a sootblower mounted in said casing below said spiral coils and including a pair of horizontally disposed structural tubular members arranged across the casing adjacent the bottom thereof, a vertically extending connecting pipe passing through one of said tubular members in concentric relation with respect to said casing and having an upper end and a lower end, a steamline extending horizontally into the interior of said casing below said coils and terminating in an interior ball joint elbow, the steamline having an outer end adapted to be connected to a source of steam, the upper end of the vertical connecting pipe being provided with an enlarged ball opening which is received within the ball joint elbow forming a fluid-tight fit with the ball but allowing a 360° movement of the vertical connecting pipe, a horizontal arm extending outwardly from the lower end of said vertical connecting pipe, a plurality of nozzles on the upper surface of said arm for directing jets of steam into the spaces between adjacent coils, a first sprocket received on said vertical connecting pipe within said one structural tubular member and rotatable with said vertical connecting pipe, a right angle drive having a vertical output shaft and a horizontal input shaft and mounted exterior of said casing on the outer end of said one structural tubular member, a second sprocket in horizontal alignment with said first sprocket and attached to the output shaft of said right angle drive, a first roller chain disposed within said one structural tubular member and passing around said first and second sprockets whereby said first and second sprockets are in driving relation with respect to each other, a third sprocket connected to the input shaft of the right angle drive, and a second chain passing around said third sprocket for permitting remote operation of the right angle drive, whereby, upon actuation of said second chain and upon introduction of steam to said steamline, said arm will rotate beneath said spiral coils and direct jets of steam between said spiral coils to remove soot therefrom.

2. The improvement as set forth in claim 1 wherein said vertical connecting pipe is journaled in said one tubular structural member by means of couplings attached to upper and lower sides of said one tubular member and through which said connecting pipe passes, a pair of pipe plugs received on said connecting pipe above and below said one structural tubular member and threadedly received in said couplings, and stuffing material received in each coupling around the connecting pipe between each pipe plug and said one structural tubing member.

* * * * *